United States Patent [19]

Neumann-Henneberg et al.

[11] Patent Number: 4,653,179

[45] Date of Patent: Mar. 31, 1987

[54] METHOD OF MANUFACTURING AN ELECTRICAL PUSH-BUTTON SWITCH

[75] Inventors: Wolf Neumann-Henneberg, Rietheim; Kuno Futterknecht, Liptingen; Gerhard Stengel; Emil Haag, both of Rietheim; Bernd Schutzbach, Tuttlingen-Mohringen, all of Fed. Rep. of Germany

[73] Assignee: Marquardt GmbH, Fed. Rep. of Germany

[21] Appl. No.: 761,019

[22] Filed: Jul. 31, 1985

Related U.S. Application Data

[62] Division of Ser. No. 627,793, Jul. 5, 1984, abandoned.

[30] Foreign Application Priority Data

Jul. 28, 1983 [DE] Fed. Rep. of Germany ..... 3327199

[51] Int. Cl.[4] ..... H01H 11/00

[52] U.S. Cl. ..... 29/622; 29/522 A; 264/267; 264/273; 428/137

[58] Field of Search ..... 29/622, 522 R, 522 A; 428/137; 264/267, 273, 249, 272.16, 272.18, 272.19, 272.21

[56] References Cited

U.S. PATENT DOCUMENTS

| | | | |
|---|---|---|---|
| 272,033 | 2/1883 | Edge | 264/249 |
| 3,489,829 | 1/1970 | Lipfert | 264/249 |
| 3,842,231 | 10/1974 | Schedele et al. | 29/622 |
| 4,059,897 | 11/1977 | Marquis | 29/622 |

FOREIGN PATENT DOCUMENTS

| | | | |
|---|---|---|---|
| 98883 | 3/1940 | Sweden | 29/622 |

*Primary Examiner*—Howard N. Goldberg
*Assistant Examiner*—P. W. Echols
*Attorney, Agent, or Firm*—McGlew and Tuttle

[57] ABSTRACT

An operating structure of an electrical switch is an assembly comprising a contact arm part, a fixed contact part and an insulating part preferably sandwiched therebetween. The contact arm part and the fixed contact arm are made of electrically conducting material. The insulating part is preferably of a thermoplastic material. The contact arm part and the fixed contact part are provided each with two securing holes. To assemble the three parts, the material of the insulating part in its portions associated with the securing holes is locally brought into a plastic state and bulged out through the securing holes. Then, the bulges are flattened, clinched or the like, at the other side to form a structure which is joined by quasi-rivets of plastic. The manufacture of this structure takes place in a timed sequence with suitable stamping and forming tools.

11 Claims, 5 Drawing Figures

METHOD OF MANUFACTURING AN ELECTRICAL PUSH-BUTTON SWITCH

This is a division of application Ser. No. 627,793 filed July 5, 1984, now abandoned.

FIELD AND BACKGROUND OF THE INVENTION

The present invention relates in general to electric switches and in particular to an operating structure for an electric switch and method of making the same which comprises an insulating part and at least one fixed contact part and at least one contact arm part both of which are connected to the insulating part. The fixed contact part and the contact arm part have securing holes or recesses for effecting their connection to the insulating part.

Such structures are employed in electrical switches, preferably of the push-button type, such as provided in typewriters and especially computers, etc. Decidedly, they are mass production articles so that manufacturing costs are the determining criterion of the market.

It is known to manufacture such an operating structure by riveting the contact arm part and the fixed contact part to the insulating part, preferably with hollow rivets. Another known method is to embed the fixed contact part and the contact arm part in an insulating part during the manufacturing of the latter as an injection molded part.

The manufacturing costs in such prior art methods are low. Only, with mass-production articles, the tendency is to lower the costs still more, to correspondingly reduce the costs of the switches. This is what the present invention is aimed at.

SUMMARY OF THE INVENTION

An object of the invention is thus to provide an operating structure of an electrical switch which comprises an insulating part, at least one fixed contact part and at least one contact arm part. The fixed contact part and contact arm part are secured to the insulating part. The fixed contact part and contact arm part have securing holes or recesses into which rivet-like protuberances of electrically non-conductive material extend, which protuberances bulge from and are made of the same material as the insulating part.

A very appreciable lowering of costs is thus obtained by omitting loose rivets and thus eliminating costs connected with a riveting process. Instead, quasi-rivets are formed out of the material of the insulating part, with this deformation and the securing taking place substantially simultaneously. This, of course, requires the use of insulating parts of a deformable material, and suitable tools. The securing holes of the contact arm part and fixed contact part must be provided at mutually offset locations, considering their position in a finished assembly, since they are "riveted" through one or more separate bulges, etc. A position secure against mutual displacement is obtained if two such protuberances are provided for both the contact arm part and the fixed contact part. The mutual position of the bulges and holes is determined by the available space and the shape of the electrically connecting parts. The securing holes are advantageously bores but they may also be recesses, however. Consequently, in the case of bores, the engaging elements are bulges or protuberances, while with recesses, these elements may be studs, lugs or the like, projecting from the insulating plug and then flattened or clinched. The shape of the protrusions primarily depends on the shape of the securing hole, yet further also on the deformability of the insulating material and the tools for this deformation.

Advantageously, the plasticized material is not only forced into the securing hole, it is sought at the same time to make it protrude to some extent on the other side of the insulating part and thus to ensure a satisfactory connection between the insulating part and the electrical conducting part.

This may very advantageously still be improved by squeezing the portion protruding beyond the securing hole, so as to form an enlarged head comparable with a rivet head. Such a connection is particularly resistant to occurring loads.

A further object of the invention is to provide such an operating structure wherein the insulating part is sandwiched between the contact arm part and the fixed contact part, with apertures of the insulating part being associated with both a fixed contact of the fixed contact part and with a movable contact of the contact arm part. This makes sure that the electrically conducting parts will be electrically separated from each other by the insulating part. To provide for making a contact, the contact arm carrying the movable contact which is, particularly, formed thereon, is resiliently bendable through the aperture of the insulating part until it touches the contact of the fixed contact part. The respective force is applied through a push-button, for example, of a keyboard within a housing where the inventive operating structures are mounted. As soon as the push-button returns into its initial position, thereby opening the previously closed circuit.

A further object of the invention is to provide such an operating structure wherein the movable contact is formed by a longitudinal slitted or feathered end of a tongue shaped contact arm of the contact arm part which is formed by stamping. The contact arm part is thus stamped out of a strip material and the contact arm is punched out simultaneously and thus forms an integral portion of the part. No special contact rivets are needed for this purpose. The movable contact is formed by a portion of the contact arm, particularly by its free end portion.

A still further object of the invention is to provide an operating structure in which the fixed contact part is a stamped part and the fixed contact is formed by a portion, particularly a sidewardly projecting lug, of the fixed contact part. Consequently, the fixed contact part is stamped from a flat sheet, particularly metal strip, with the details of shape and the securing holes being punched out simultaneously.

It follows from the foregoing that the inventive structure comprises only three parts, which, along with the provided manufacturing and connecting steps as will be explained hereinafter, is the reason for the extraordinarily lowered manufacturing costs. In addition, the structure can be made particularly small-sized, thus compact and very flat, so that it requires a minimum space in the respective accommodating housing. This is a substantial contribution to a miniaturization of both the switch and the keyboard.

A particularly preferred embodiment of the invention provides for an operating structure in which both the fixed contact part and the contact arm part are formed with an electrically connecting element for the operating structure. Advantageously, the connecting element is tongue-shaped, to be introducible into a corresponding slot provided in the housing of the switch. The inventive operating structure is fixed in the switch, for example, by turning the free end of the connecting elements passed therethrough, about their longitudinal axes.

The invention further relates to a method of manufacturing the structure which is as simple and fast as possible and thus inexpensive.

Another object of the invention is to provide a method of manufacturing an operating structure comprising stamping a contact arm part and a fixed contact part from a flat, electrically conductive material, stamping an insulating part from a flat, electrically non-conductive material, placing the insulating part and one of the electrically conductive parts on each other, aligning these two parts with each other and then riveting them together by bringing the insulating part and at least a portion associated with one securing hole of the electrically conducting part, into a state of plastic deformation and forming the material as a protrusion through the hole, and connecting the other electrically conductive part upon bringing it into alignment with the remainder of the structure.

The placing of the parts of the structure one above the other and aligning them may also be effected automatically. The same goes for the following bulging or squeezing out of the protuberances forming the securing elements, through the holes of the electrically conducting parts. Advantageously, these operations are effected in a predetermined cycle. As to whether to connect the conducting parts to the insulating part simultaneously or successively depends on the various component parts. For example, it matters whether the electrically conducting parts are applied against one and the same side of the insulating part, or from two sides. In the first case, a spacing must be provided between the electrically conducting parts, in the second case, they are automatically insulated from each other. To be able to establish the wanted contact, however, the contact arm of the contact arm part must extend opposite to the fixed contact of the fixed contact part, with an intermediate space therebetween. The simultaneous interconnection of the three parts may further depend on how the plastic deformation is effected and how the special tools, if provided, are shaped and conformed to the parts.

A development of the method provides flattening of the outwardly projecting protrusions. This is advantageously done by forming a kind of a rivet head which might even slightly be pierced open. In any case, the obtained connection is very reliable, loadable both lengthwise of and across the protuberance, safe against vibrations, and suitable for extremely high endurance numbers.

Another development of the method provides that all of the three parts are made by stamping or punching from a strip material in a way such that the individual parts remain connected to each other by a material bridge, i.e. at least one material strip. This primarily helps in automatic manufacturing processes with suitable tools. The parts are stamped from the initial strip with a predetermined spacing and in their final shape, but they remain connected to each other by a bridging strip, preferably on one of their sides. The stamping may be performed in one or more steps. In this latter case, the stepping during the process corresponds to the spacing of the adjacent parts still connected to the bridging or carrier strip. The carrier strip is used for feeding the parts both in the stamping steps, if provided, and during the stepwise association of two, or all three of the parts. The spacing from each other of the parts on the carrier strip depends on the most economical use of material, and on the special relations which determine the step size.

In a particularly preferred modification of the method, in which the parts are assembled sequentially, the strip carrying the insulating parts and one of the strips with the electrically conducting parts, such as the contact arm parts, are moved parallel to each other, while the strip with the other electrically conducting parts is moved transversely thereto, preferably at right angles. In this way, they are intermittently fed. The feed step depends on the mutual spacing of the parts on the strips and their extension, as already mentioned above.

In still another development, each insulating part is separated from its carrying strip after it has been riveted to one of the electrically conducting parts, particularly the contact arm part, or during this riveting process. Similarly, the other electrically conducting part is cut from its carrier strip after being riveted to the insulating part, or during this riveting process. After all the three parts are thus assembled with each other, they may also be fed farther, if needed, by the carrier strip of one of the electrically conducting parts. Otherwise, the individual, already assembled operating structures may be separated from the last carrying strip simultaneously with the "riveting" of this last electrically conducting part, which may be the fixed contact part. Under specific conditions, the process depends primarily on whether still further operations, or an automatic mounting are provided, with the latter alternative being particularly compatible with the inventive method.

Advantageously, during the assemblage, the strip carrying the contact arm parts moves stepwise, in accordance with the manufacturing cycle, in a lower plane. The insulating parts are in a median plane, and the fixed contact parts are in an upper plane. Since the material is flexible, however, the strips moving parallel with each other may move in the same plane.

The last provided operating step is the separation of one of the electrically conducting parts, particularly the contact arm part, from the carrying strip, which is done simultaneously with the separation of the other electrically connecting part, or in another operating step.

A still further object of the invention is to provide an operating structure which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following the invention is explained in more detail with reference to the diagrammatical drawings in which.

DESCRIPTION OF THE PREFERRED EMBODIMENT

Figure 5:
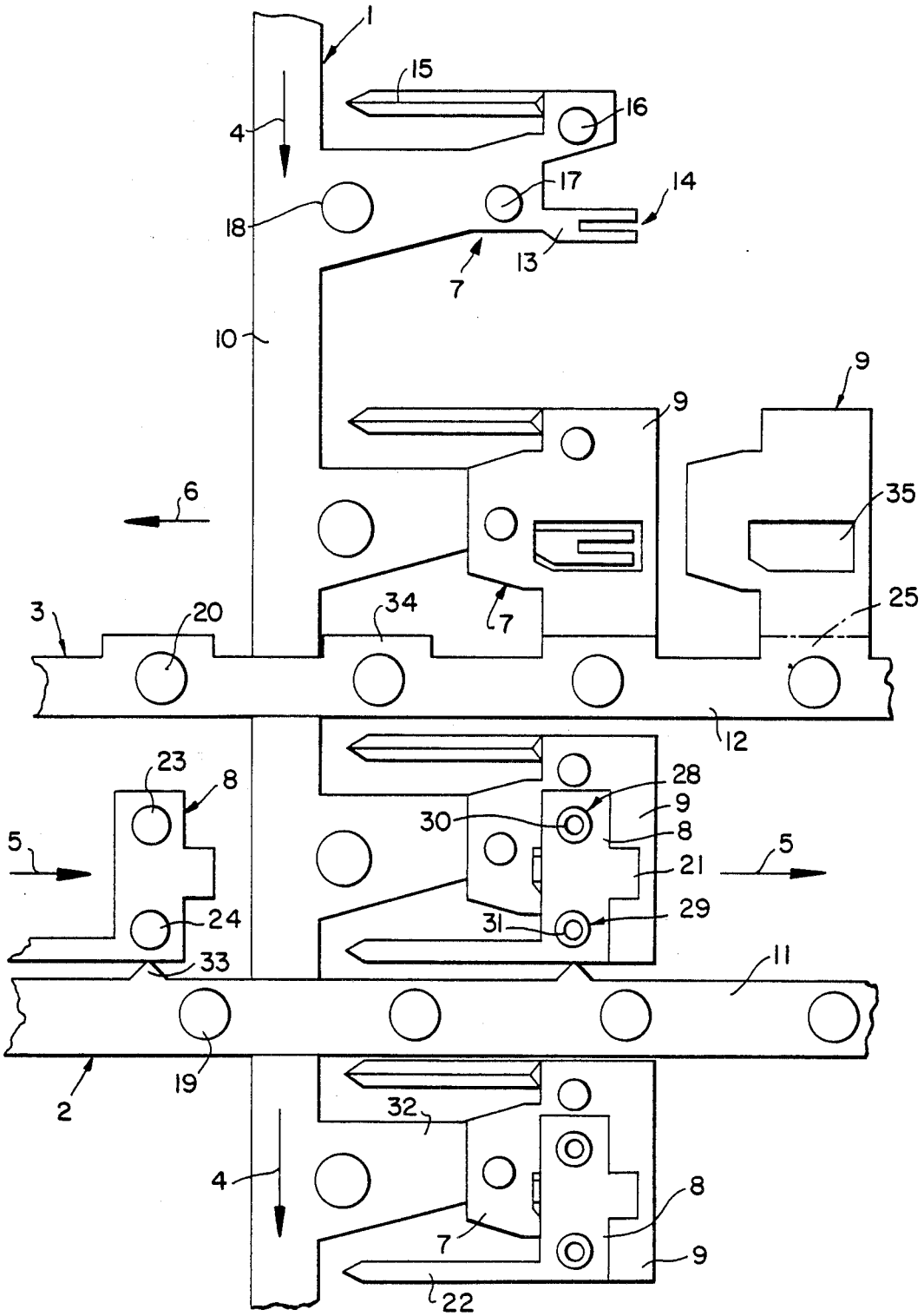
FIG. 5 is an illustration of the process of manufacturing the inventive structure.

Referring first to FIG. 5, the inventive structure is advantageously manufactured from three flat strips, with strips 1 and 2 being of an electrically conducting material, and strip 3 being of an electrically non-conducting material, especially a thermoplast. Instead of a thermoplast, of course, pressboard or a similar plastically deformable material may be used. Strips 2 and 3 extend parallel to each other in the same plane or in planes which are slightly vertically offset such as by the material thickness, while strip 1 extends transversely, preferably at right angles, thereto. It is provided, particularly, that strips 2 and 3 extend over strip 1. The feed directions of strips 1,2,3 are indicated by arrows 4,5,6. The feed is deflected stepwise, as will be explained later.

Contact arm parts 7 are stamped in, or from strip 1, fixed contact parts 8 from strip 2, and insulating parts 9 from strip 3. All the stamped parts, however, initially remain integral with material bridges which thus form carrier strips 10, 11, 12, respectively, for the parts, and preferably extend at the side. Later, at predetermined instants, these parts will be separated from the carrier strip. As shown, contact arm part 7 comprises a contact arm 13 including a movable contact 14, and a connecting element 15 extending in the opposite direction. The movable contact 14 is formed by a forked free end of contact arm 13. No special contact rivets are provided in this embodiment. In the same, or an additional, operation, two securing holes 16 and 17, and a slightly larger hole 18 used for feeding the carrier strip 1, are punched out. Corresponding holes 19,20 are provided in the two other carrier strips 2 and 3.

Insulating part 9 is provided with a rectangular aperture 35 which, in assembled state, is associated with contact arm 13 and with a fixed contact 21 of fixed contact part 8. This fixed contact 21 is a sideward projecting lug of fixed contact part 8 which part also is shaped with a connecting element 22 similar to that of part 7 at 15. Fixed contact part 8 is further provided with two securing holes 23, 24.

Figure 3:
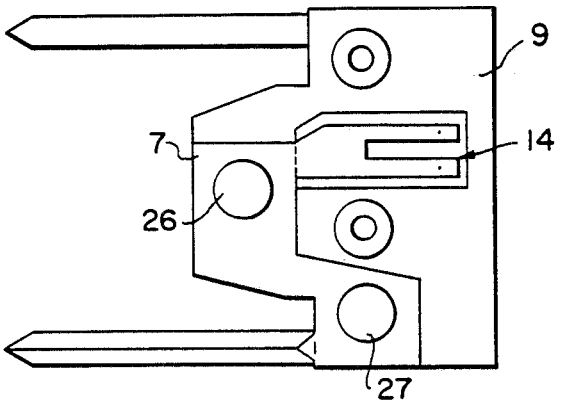
FIG. 3 is a bottom plan view corresponding to FIG. 1.
Figure 2:
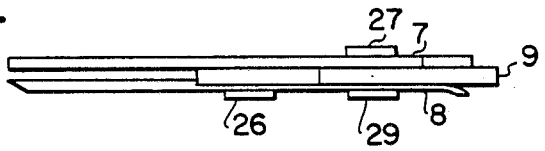
FIG. 2 is a side view corresponding to FIG. 1.
Figure 1:
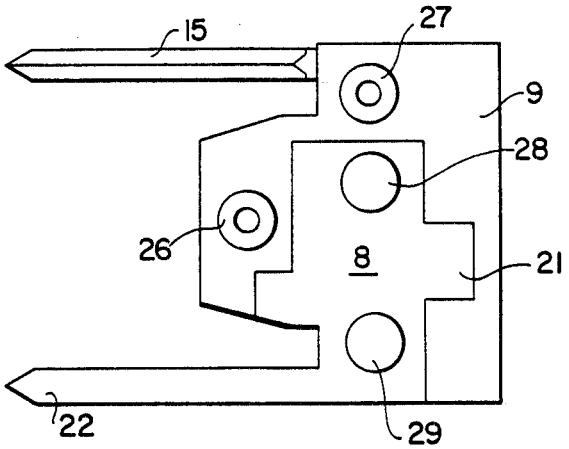
FIG. 1 is a top plan view of an operating structure of the invention in assembled state.

After the stamping operation, but prior to separating the parts from their carriers, one contact arm part 7 is brought into association with one insulating part 9, with the feed taking place in the direction of arrows 4, 6. With the associating feed steps accomplished, the two parts become superimposed on each other, in accordance with FIG. 5. Now, by means of a suitable tool, the material of insulating part 9 is pushed out, in the direction behind the drawing plane, at the locations corresponding to securing holes 16,17. A plastic deformation is provided, i.e. the material pushed or squeezed out of the plane of insulating part 9 remains on this part in the shape of bulges 26,27 or protuberances which extend into the two securing holes 16,17 (See FIGS. 1–3). Particularly, it is provided to have the bulges of protuberances protruding through and beyond the holes, in the direction behind the drawing plane, so that the projecting end can then be pressed flat in the opposite direction, by means of another tool, whereby a protrusion is formed similar to a rivet head.

Simultaneously with this "riveting", or in a subsequent step, insulating part 9 is separated from its carrier along the dash-dotted line 25.

Figure 4:
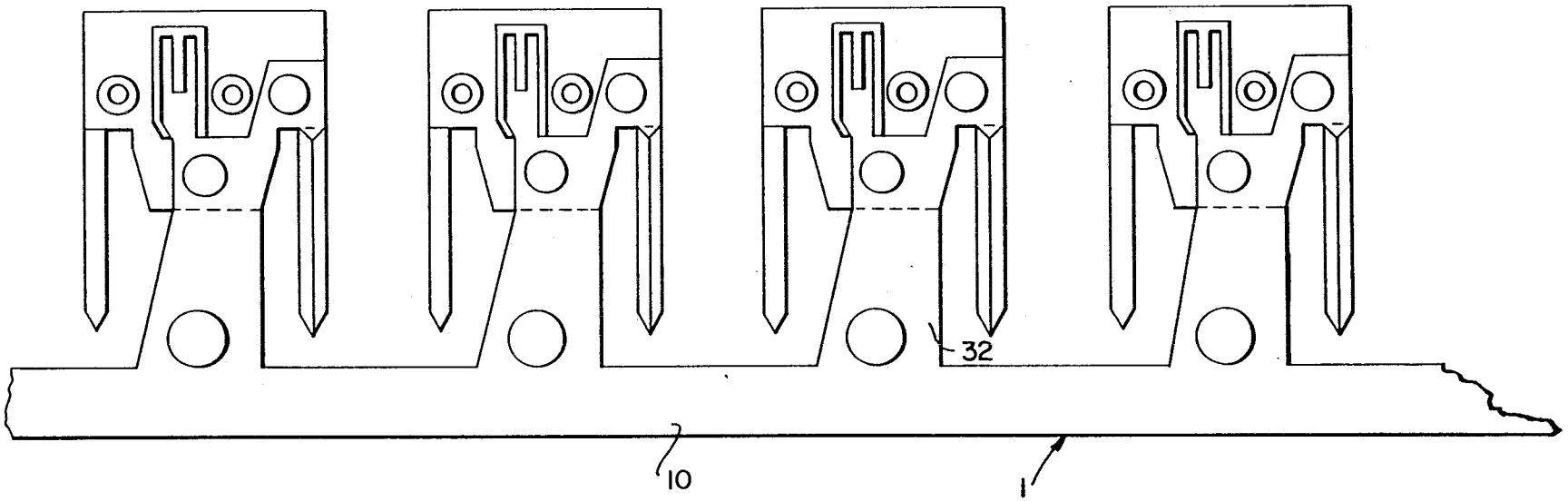
FIG. 4 shows, on a slightly smaller scale, a bridging strip carrying four assembled operating structures, before they are separated from the carrier strip.

In another step, this sub-assembly of the contact arm part, and the insulating part is fed farther, in the direction of arrow 4. Simultaneously, or subsequently, a fixed contact part 9 is moved thereabove. Then, force is applied from behind the drawing plane locally to press material of insulating part 9 out through securing holes 23, 24. The thus formed protuberances 28, 29 are also pressed flat or clinched, particularly while piercing them open at the same time, which is indicated by the small circles 30, 31. An instant separation from carrier strip 10 or stub 33 is not provided in this shown embodiment, the assembly is moved farther with carrier strip 1 in a following feed step, in the direction of arrow 4 (FIG. 4). However, where and when to provide the separation depends on the tools which are employed, and on the further handling intended. The stubs of carrier strips 2 and 3, corresponding to stub 32 of strip 1, are designated 33 and 34, respectively. While stubs 32 and 34 are relatively broad, stub 33 of fixed contact part 8 is rather pointed and narrow.

While a specific embodiment of the invention has been shown and described in detail to illustrate the application of the principles of the invention, it will be understood that the invention may be embodied otherwise without departing from such principles.

What is claimed is:

1. A method of manufacturing an operating structure for an electric switch having an insulating part to which is connected a contact arm part and a fixed contact part, comprising:

stamping out the contact arm part from a flat, electrically conducting material;

forming at least one securing hole in the contact arm part;

stamping out the fixed contact part from a flat, electrically conducting material;

forming at least one securing hole in the fixed contact part;

stamping out the insulating part from a flat, electrically non-conducting material;

placing the insulating part on and into alignment with one of the contact arm part and fixed contact part;

plastically deforming a portion of the insulating part into the at least one securing hole of the one part to form a rivet-like protrusion into the securing hole so as to connect the insulating part to the one of the contact arm part and fixed contact part;

bringing the insulating part with the connected one of the contact arm part and fixed contact part, into alignment and over the other of the contact arm part and fixed contact part; and connecting the other of the contact arm part and fixed contact part to the insulating part.

2. A method according to claim 1, including connecting the other of the contact arm part and fixed contact part to the insulating part by plastically deforming another portion of the insulating part into the securing hole of the other part to form a rivet-like protrusion into the securing hole of the other part.

3. A method according to claim 2, including flattening each protrusion of the insulating part against the contact arm part and fixed contact part respectively.

4. A method according to claim 1, including stamping out the contact arm part, fixed contact part and insulating part from separate strips of material to which the contact arm part, the fixed contact part and the insulating part are connected respectively by material bridges, each of said strips having a plurality of identical respective parts.

5. A method according to claim 4, including moving the strip carrying the insulating parts parallel to the strip carrying the contact arm parts and moving the strip carrying the fixed contact parts transversely to the strips carrying the insulating parts and contact arm parts for aligning the insulating part respectively with the contact arm parts and fixed contact parts.

6. A method according to claim 4, including separating the insulating part from its strip after the insulating part has been connected to the one of the contact arm part and fixed contact part.

7. A method according to claim 4, including separating the insulating part from its strip during the connection of the insulating part to the one of the contact arm part and fixed contact part.

8. A method according to claim 7, including separating the other of the contact arm part and fixed contact part from its strip after the other part has been connected to the insulating part.

9. A method according to claim 7, including separating the other of the contact arm part and fixed contact part from its strip during the connection of the other part to the insulating part.

10. A method according to claim 4, including conveying plurality of operating structures each including an insulating part, a contact arm part and a fixed arm part by moving the strip to which each of the contact arm parts are connected.

11. A method according to claim 1, including moving the contact arm part in a plane parallel to and beneath a plane containing the insulating part and moving the insulating part in a plane parallel to and below a plane containing the fixed contact part wherein the contact arm part and the fixed contact part are connected on opposite sides of the insulating part.

* * * * *